US009954331B2

(12) United States Patent
Peach

(10) Patent No.: US 9,954,331 B2
(45) Date of Patent: Apr. 24, 2018

(54) TERMINAL AND DISCONNECTION LINK

(71) Applicant: PIVOT ELECTRONICS PTY LTD, Warriewood, New South Wales (AU)

(72) Inventor: Philip Louis Peach, Church Point (AU)

(73) Assignee: PIVOT ELECTRONICS PTY LTD, Warriewood, New South Wales (AU)

( * ) Notice: Subject to any disclaimer, the term of this patent is extended or adjusted under 35 U.S.C. 154(b) by 0 days.

(21) Appl. No.: 14/784,190

(22) PCT Filed: Apr. 15, 2014

(86) PCT No.: PCT/AU2014/000441
§ 371 (c)(1),
(2) Date: Oct. 13, 2015

(87) PCT Pub. No.: WO2014/169339
PCT Pub. Date: Oct. 23, 2014

(65) Prior Publication Data

US 2016/0056599 A1 Feb. 25, 2016

(30) Foreign Application Priority Data

Apr. 16, 2013 (AU) ..... 2013901323

(51) Int. Cl.
*H01R 9/26* (2006.01)
*H01R 31/08* (2006.01)
*H01R 13/64* (2006.01)

(52) U.S. Cl.
CPC ..... *H01R 31/08* (2013.01); *H01R 9/26* (2013.01); *H01R 9/2666* (2013.01); *H01R 13/64* (2013.01)

(58) Field of Classification Search
CPC ..... H01R 9/2666; H01R 4/4845; H01R 9/26; H01R 9/2608; H01R 4/4827; H01H 85/547; H01H 85/56; H01H 85/58; H01H 85/60
(Continued)

(56) References Cited

U.S. PATENT DOCUMENTS 3,171,939 A 3/1965 Ustin
4,108,522 A 8/1978 Favale
(Continued)

FOREIGN PATENT DOCUMENTS

EP 2 204 886 A1 7/2010
WO WO 2011/013260 A1 3/2011

OTHER PUBLICATIONS

International Search Report and Written Opinion for International Application No. PCT/AU2014/000441, dated Jun. 30, 2014, 12pp.
(Continued)

*Primary Examiner* — Renee S Luebke
*Assistant Examiner* — Paul Baillargeon
(74) *Attorney, Agent, or Firm* — Lewis Roca Rothgerber Christie LLP

(57) ABSTRACT

A terminal unit has a terminal unit body, a first terminal connector located adjacent a first opening in the terminal unit body for connection of a first conductor passing through the first opening, and a second terminal connector located adjacent a second opening in the terminal unit body for connection of a second conductor passing through the second opening. The first terminal connector conductor terminates internally of the terminal unit at a first link connection point, and the second terminal connector conductor terminates internally of the terminal unit at a second link connection point. The first and second link connection points are accessible via a link opening in the terminal unit body and
(Continued)

a removable link comprising a link conductor and a link handle is removably insertable into the link opening. With the removable link inserted a normal orientation, the link conductor electrically connects the first link connection point and the second link connection point to electrically connect the first terminal connector to the second terminal connector.

17 Claims, 8 Drawing Sheets

(58) Field of Classification Search
USPC ..... 439/512, 513, 949, 114, 508–511, 828
See application file for complete search history.

(56) References Cited

U.S. PATENT DOCUMENTS 5,090,922 A 2/1992 Rymer et al.
6,017,251 A * 1/2000 Rittmann ..... H01R 9/2608 439/716
7,223,117 B2 * 5/2007 Pratt ..... H01R 9/2475 439/409
7,658,639 B2 * 2/2010 Hoppmann ..... H01R 4/4827 439/142
7,658,653 B2 * 2/2010 Diekmann ..... H01H 85/2045 439/715
2008/0248698 A1 * 10/2008 Pizzi ..... H01R 13/68 439/709
2015/0147907 A1 * 5/2015 Goerlitzer ..... H01R 9/2625 439/512

OTHER PUBLICATIONS

Wago, "General Catalogue W4 vol. 1 Rail-Mounted Terminal Block Systems", Oct. 2005 [Retrieved on May 22, 2014]. Retrieved from the Internet <URL: http://www.wago.com/infomaterial/pdf/51163656.pdf> Section 7-10, Figure of product 280-829; Section 7-13, Figure bottom of page; Section 7-4.

Supplementary European Search Report dated Nov. 8, 2016 for corresponding European Patent Application No. 14785367.5, 10pp.

General Catalogue W4, vol. 1, Rail-Mounted Terminal Block Systems, Oct. 1, 2005, XP055286266, http://www.wago.com/infomaterial/pdf/51163656.pdf, 432pp.

* cited by examiner

TERMINAL AND DISCONNECTION LINK

CROSS-REFERENCE TO RELATED APPLICATIONS

This application is a national phase application under 35 U.S.C. § 371 of International Application No. PCT/AU2014/000441, filed on Apr. 15, 2014, which claims the benefit of Australian Provisional Application No. 2013901323, filed on Apr. 16, 2013, the disclosures of which are incorporated herein by reference in their entirety.

INTRODUCTION

The present invention relates to electrical terminals particularly for industrial applications and in particular the invention provides a terminal unit incorporating a removable link.

BACKGROUND

Terminal connectors for power and signal wiring to industrial equipment come in many forms and provide a multitude of functions. One particular style of connector that has become popular particularly for wiring in environments subject to vibration employs a 'screw-less type terminal with direct pressure' (as defined in Annex D of IEC 60947_1: 2004. "Low-voltage switch gear and control gear Part 1: general Rules and referred to herein as "screw-less type terminals". Such terminals are often used to make permanent wiring connections to industrial equipment. Screw-less type terminals generally include a strong spring that maintains pressure on a conductor clamp in which the terminated conductor is securely retained. Screw-less type terminals may be "tool-less" or may require a tool such as a "hex" or "Allen" key or screwdriver to compress the spring, removing pressure from the conductor clamp and allowing insertion of a conductor into the terminal. Tool-less type terminals will often include a lever incorporated into the terminal body to compress the spring removing pressure on the conductor clamp.

In industrial situations it is sometimes necessary to disconnect a circuit while maintenance is performed on a piece of equipment. Sometimes switches are provided for the purpose of isolating equipment but there is always the possibility that a switch may be switched on while a worker is working on the connected circuit. This is often addresses by tagging the switch with a danger tag indicating that the circuit is being worked on. Switches may also be lockable but this is a more expensive solution which may not be justified where maintenance is infrequent.

Terminals may also be provided with test points that permit the insertion of a probe or plug for voltage measurement or, link with the link removed, a current meter may be connected in series. Removal of the link may also be used as a means of isolating the circuit for maintenance, but leaves the circuit prone to reconnection without warning if someone replaces the link.

Prior art disconnect terminals typically use a circular pin as the connection link. The pin fits into a small circular hole which is similar in size to a 4 mm test socket which is quite dangerous. If the circular pin is removed, it exposes the hole which is the same size as 4 mm test points located on either side of the link (i.e. 3×4 mm holes in a row). Therefore if the link is removed and a technician is working on the circuit, a second technician could in error insert a test lead plug into the centre hole by mistake and expose his workmate to supply voltage.

SUMMARY

According to a first aspect, a terminal unit comprises a terminal unit body, a first terminal connector located adjacent a first opening in the terminal unit body for connection of a first conductor passing through the first opening, a second terminal connector located adjacent a second opening in the terminal unit body for connection of a second conductor passing through the second opening, the first terminal connector conductor terminating internally of the terminal unit at a first link connection point, the second terminal connector conductor terminating internally of the terminal unit at a second link connection point, the first and second link connection points accessible via a link opening in the terminal unit body and a removable link comprising a link conductor and a link handle, the removable link being removably insertable into the link opening, in a normal orientation, with the link conductor electrically connecting the first link connection point and the second link connection point to electrically connect the first terminal connector to the second terminal connector, the link handle comprising an insulator which projects from the opening when the link conductor is inserted to electrically connect the first link connection point and the second link connection point, such that the link handle enables gripping of the link for removal without touching the link conductor.

The removable link may be shaped to co-operate with the housing to engage the housing for storage, when the link conductor is not electrically connecting the first link connection point and the second link connection point. This may be achieved by shaping the link handle to fit into the opening in the terminal unit body, whereby the removable link may be inserted in a reverse orientation with the handle inserted into the opening and without connecting the first link connection point to the second link connection point. In this reverse orientation, the link handle will block access to the first link connection point and the second link connection point via the opening. The handle may include one or more resilient projections that engage one or more walls of the opening to retain the handle within the opening. The one or more resilient projections of the handle may engage one or more notches in the walls of the opening when the handle is inserted into the opening.

The removable link may also include an insulating sheath surrounding part of the link conductor. The insulating sheath may also include one or more resilient projections that engage one or more walls of the opening to retain the removable link within the opening. The one or more resilient projections of the sheath may also engage one or more notches in the walls of the opening when the removable link is inserted into the opening. The handle and sheath may be of different colours such that the sheath colour is visible when removable link is inserted into the opening in reverse orientation with the handle inserted in the opening or if the removable link is not fully inserted into the opening in normal orientation.

The first link connection point and the second link connection point may sit side by side within the opening separated by an insulating wall such that they cannot be connected by a straight conductor. The link conductor may comprise a flat "U" shaped conductor which, when inserted into the opening, spans the wall and contacts each of the first link connection point and the second link connection point.

A test socket may be connected to one of the first link connection point and the second link connection point, or each of them may have a socket connected to it. The test socket or sockets may be standard 4 mm test sockets and may be located on either side of the opening.

The first terminal connector and the second terminal connector may be screw-less type connectors. They may also be tool-less screw-less type connectors.

The terminal unit may be arranged to mount on several different mounting systems. In one embodiment the terminal unit is arranged to mount on either of a DIN-rail or a G-rail. The terminal unit may be adaptable to mount on different mounting systems by replacing a part of the terminal unit.

BRIEF DESCRIPTION OF THE DRAWINGS

An embodiment of the terminal unit will be described with reference to the accompanying drawings in which.

DETAILED DESCRIPTION OF AN EMBODIMENT

An embodiment of the terminal unit illustrated in FIGS. 1 to 8 provides an industrial-grade, rail-mounted disconnector unit that complies with AS 60947.1-2004 and AS/NZS 3947.3:2001. This provides a device that is compact and quick to install, and capable of withstanding the ferociously hostile environments that pervade heavy industry generally, and railway trackside installations in particular. This device can operate at up to 600V ac or dc and can bear a maximum continuous load current of 40 A in a steady 60° C. ambient, or 32 A in a 70° C. ambient.

Figure 1:
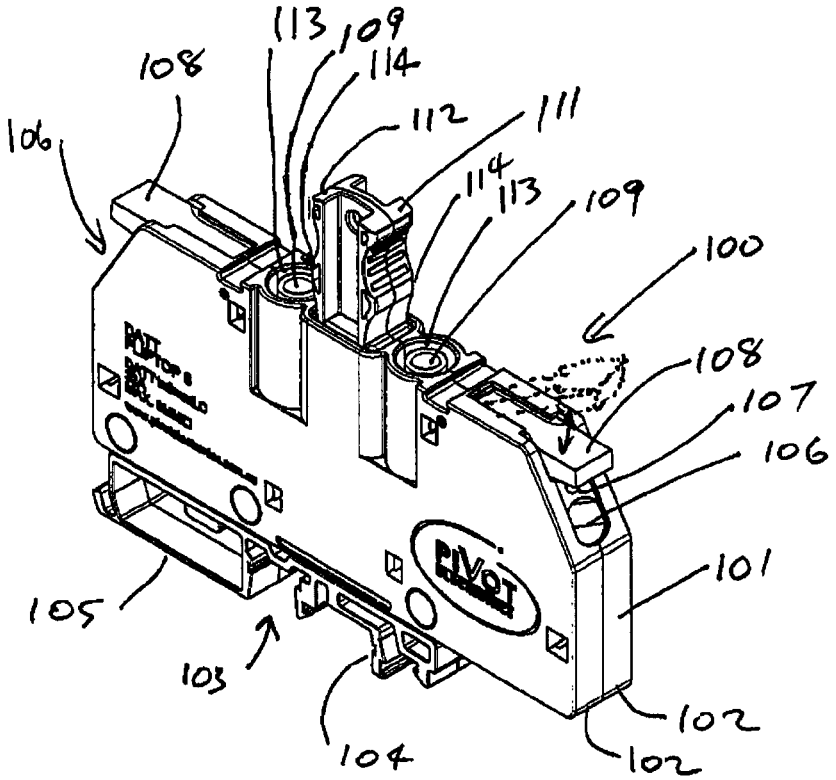
FIG. 1 shows a perspective view of a terminal unit with a removable disconnect link inserted.

FIG. 1 illustrates the terminal unit 100 with a removable disconnect link 111 inserted. The terminal unit 100 is also illustrated with the removable disconnect link 111 removed in FIG. 2. The terminal unit includes a body 101 made of two half shells 102. Within the body 101 two terminals 106 are provided which are of the type known as 'screw-less type terminals with direct pressure' (as defined in Annex D of IEC 60947_1:2004 "Low-voltage switchgear and control gear Part 1: General Rules, and referred to herein as "screw-less type terminals"). The Two terminals 106 are located at opposite ends of the body 101 (only one terminal 106 visible in FIG. 1) and are operated by levers 108 which pivot into lifted position (dashed lines in FIG. 1) to release pressure on a clamp within the terminal and pivot to a lowered position (solid line in FIG. 1). In the lowered position the leaver allows pressure to be applied to the clamp to clamp a wire inserted into the terminal. This is known as a tool-less type terminal, however in an alternative embodiment a variety of screw-less terminal may be used that relies on a tool such as a screwdriver or other blade to remove the clamping force from the clamp.

A 2 mm test socket 107 is provided above each terminal 106, capable of receiving a 2 mm plug for connection of a test instrument or the like.

Figure 3:
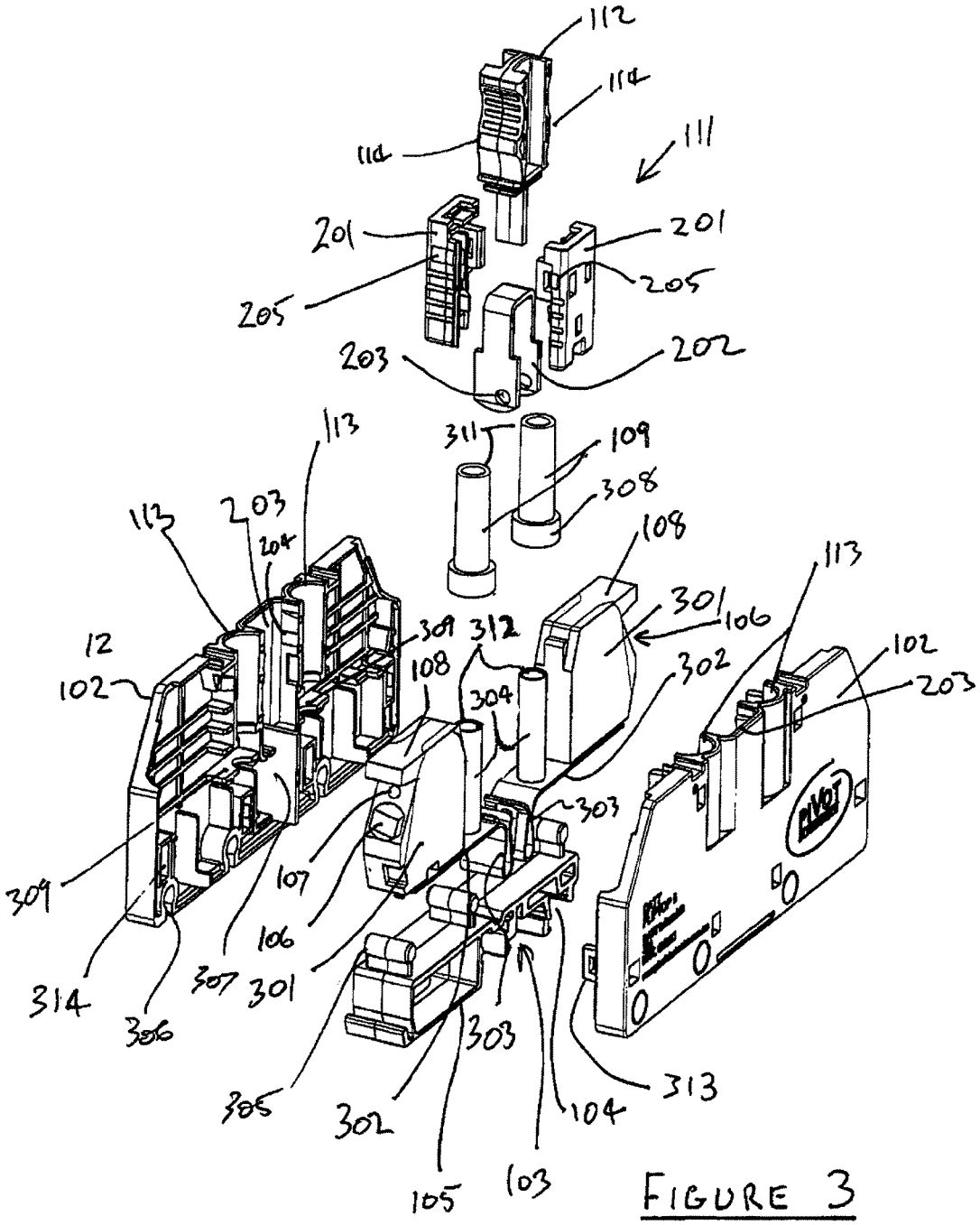
FIG. 3 shows an exploded perspective view of the terminal unit of FIGS. 1 and 2.

FIG. 3 is an exploded view of the terminal unit 101, from which the internal structure of the terminal unit can be observed.

A mounting strip 103 is located on the bottom of the body and provides a DIN-rail mount 104 and a G-rail mount 105 for alternatively mounting the terminal body 101 on either a DIN-rail or a G-rail. Referring to FIG. 3 it will be seen that the mounting strip 103 includes projections 305 which mate with key-holes 306 in the base of each shell half 102 to attach the mounting strip to the body 101. This arrangement allows the design of the terminal unit 100 to be readily altered to provide a different type of mounting by simply replacing the mounting strip 103. The mounting strip is more clearly illustrated in FIG. 7. Other mounting arrangements may be accommodated by replacing the mounting strip 103 with a strip having an alternative mounting configuration.

On the upper surface of the terminal unit, shrouded 4 mm test sockets are provided in openings 113 adjacent each of the terminal clamp leavers 108. The shroud 109 of the 4 mm socket is visible within the opening 113. The handle 112 of the removable link 111 is seen to project out of the body 101 between the 4 mm sockets (refer to FIG. 1).

Figure 2:
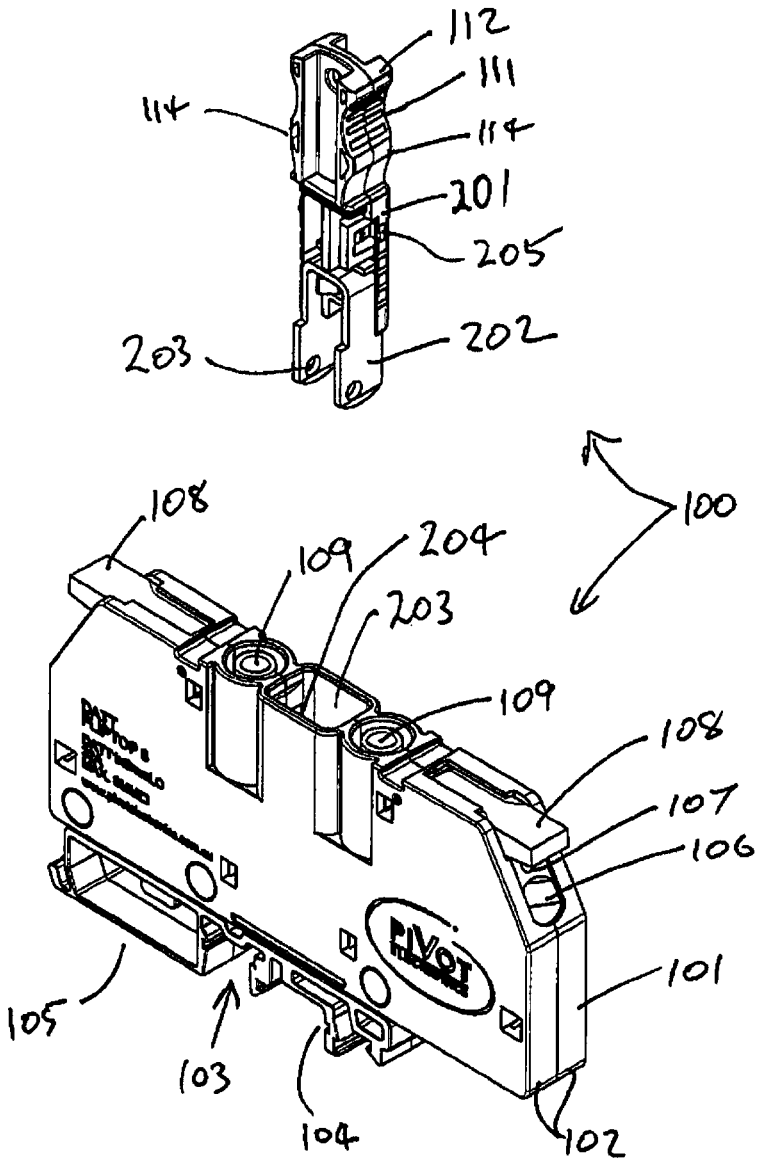
FIG. 2 shows a perspective view of a terminal unit of FIG. 1 with the removable disconnect link retracted.

In FIG. 2, the link 111 is shown removed from an opening 203 in the body 101 in which it normally resides. The link 111 comprises a metal staple 202, a first housing part 201 (shown partly removed) and a second housing part 112 which forms the handle of the link for insertion and removal (in the normal orientation). The first housing part 201 (the shroud) and the second housing part 112 (the handle) are each assembled from two half mouldings joined together. An exploded view of the link is visible in FIG. 3 and the link is shown in an inverted orientation in FIG. 6 which will be discussed in detail later.

Figure 5:
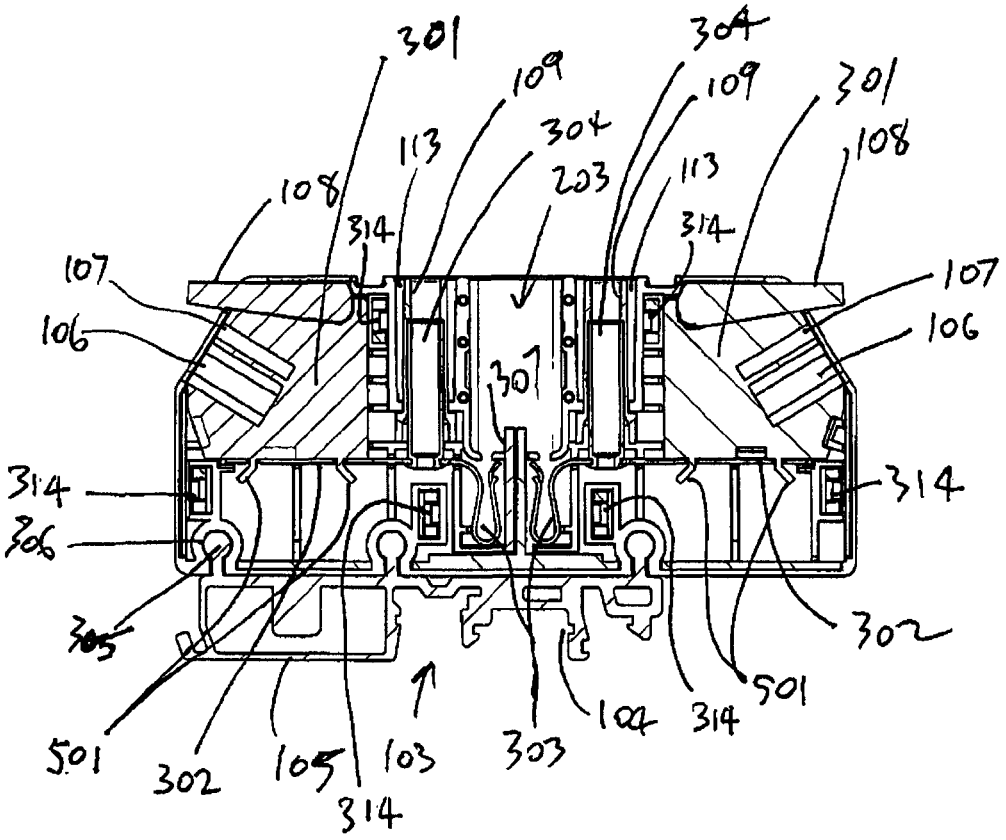
FIG. 5 shows a sectional view of the terminal unit of FIGS. 1, 2 and 3 and 4 without the link viewed through the plane of separation of the housing.
Figure 6:
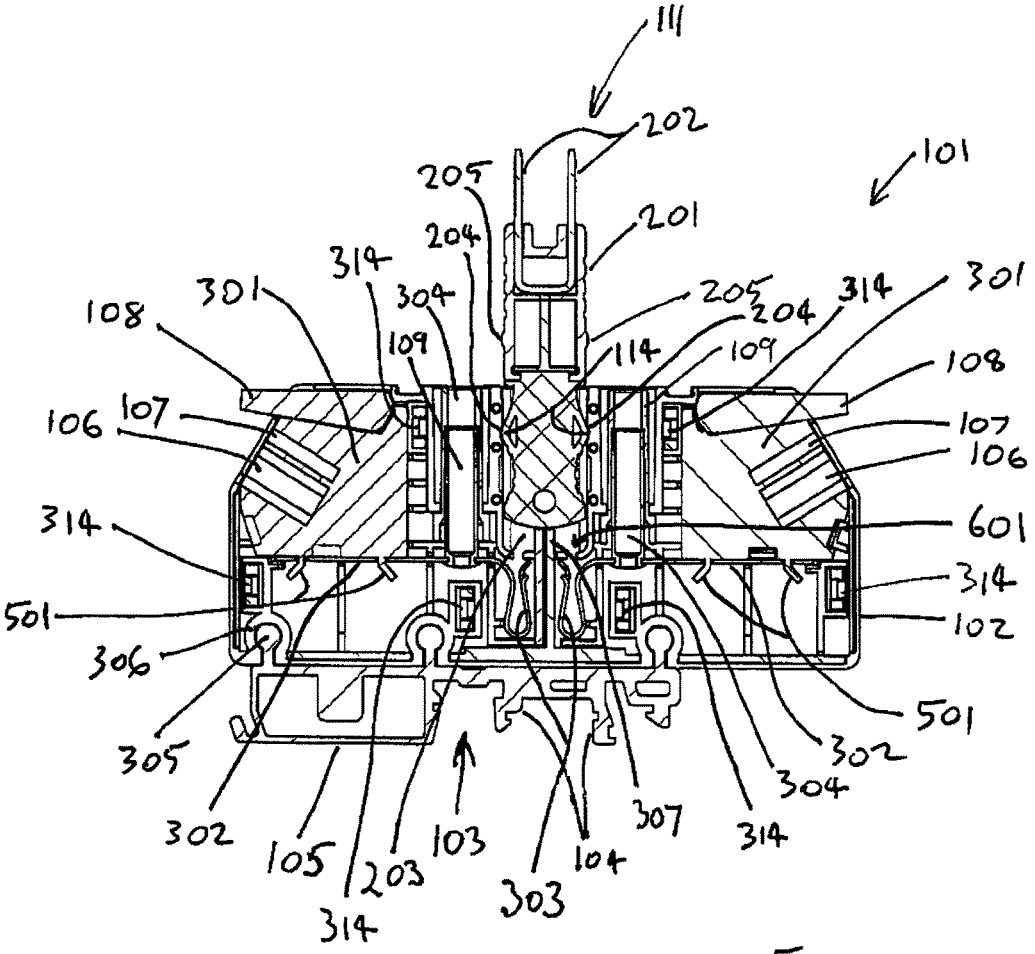
FIG. 6 shows a sectional view of the terminal unit of FIGS. 1, 2 and 3 and 4 with the link inserted in a reversed orientation viewed through the plane of separation of the housing.
Figure 7:
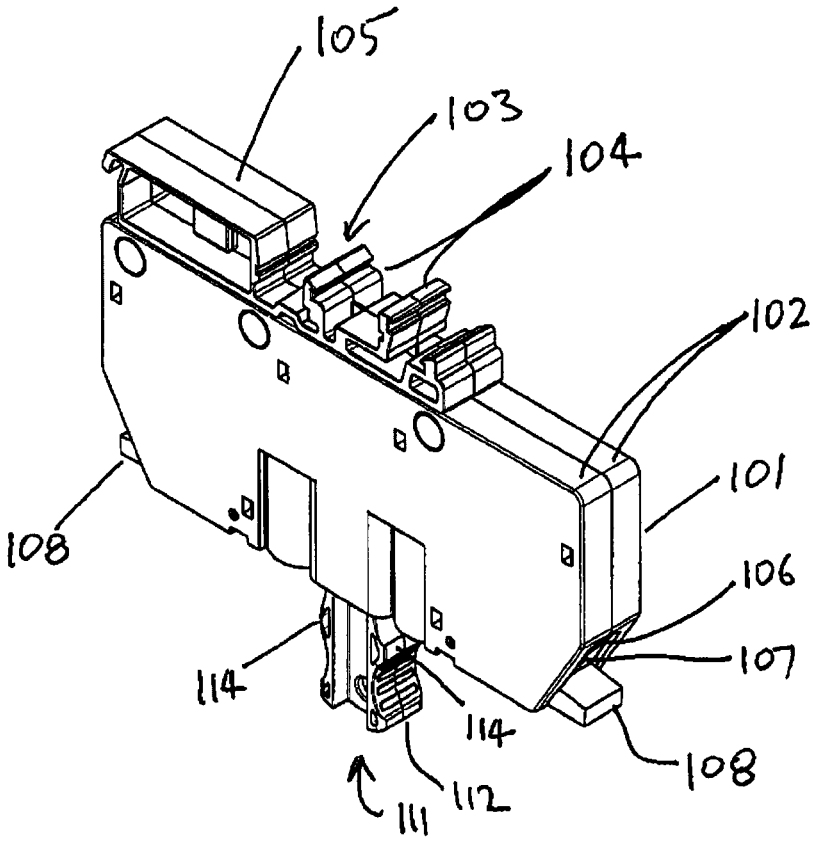
FIG. 7 shows an inverted perspective view of the terminal unit of FIGS. 1 to 6.

As seen in FIG. 3, internally the terminal unit has two screw-less terminal bodies 301 each soldered to a respective metal strip 302. Referring to FIGS. 5 & 6, metal 501 can be seen extending through the metal strips 302 and it is these tabs that are soldered to the metal strips to physically bond and electrically connect the terminal bodies 301 to the metal strips 302. The screw-less contact bodies 301 incorporate the screw-less terminals 106 and the 2 mm test sockets 107. The metal strips 302 each have a terminal end which is bent to form a folded contact 303 which accepts one blade of the staple 202. This design avoids the use of a round opening that could be mistaken for a test socket. The use of the flat staple shaped link and the co-operating pair of folded contacts makes it impossible to short out the circuit with a round 4 mm test lead plug.

Figure 4:
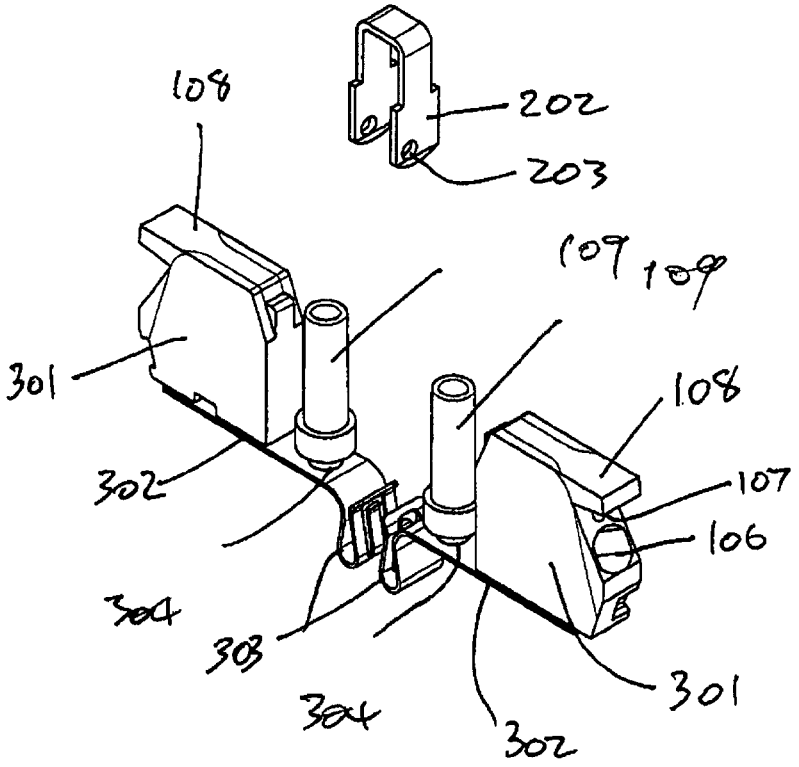
FIG. 4 shows a detail of the conducting path of the terminal unit of FIGS. 1, 2 and 3.
Figure 8:
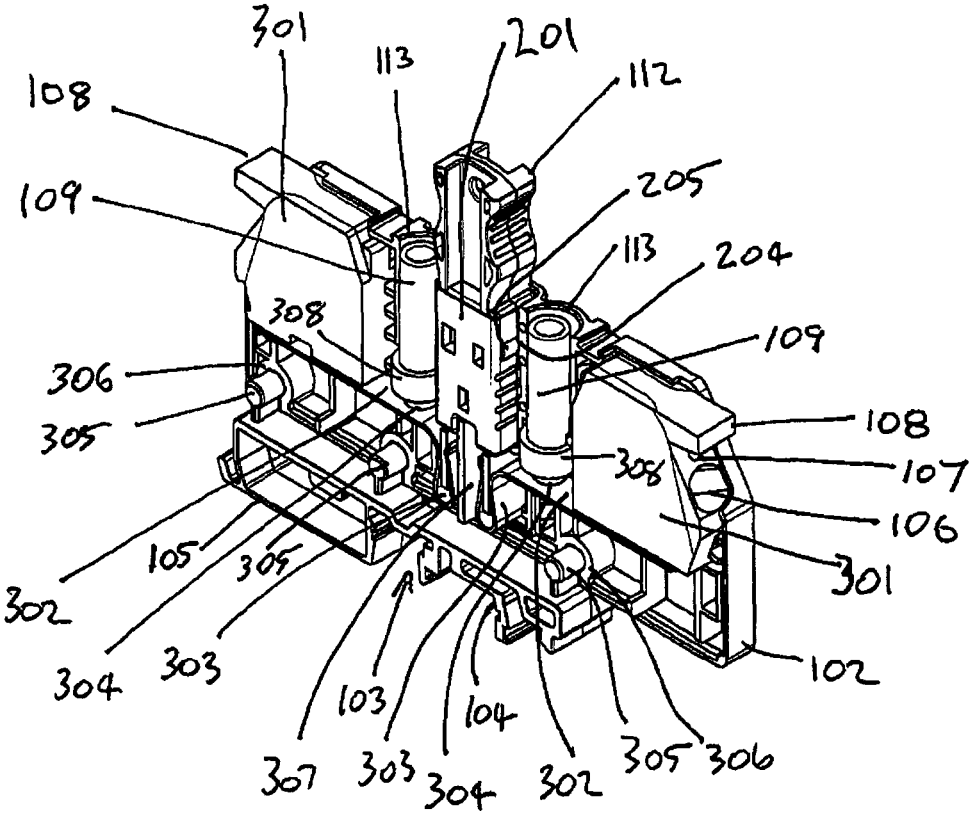
FIG. 8 shows a perspective view of the terminal unit of FIGS. 1 to 6 with the link inserted and one half of the housing removed.

Metal tubes 304 riveted through the metal strips 303 form the contact of the 4 mm test points and the insulating shrouds 109 extend over the tubes 304 and are anchored into the shell halves 102 by stepped lower ends 308 which sit under projections 309. The upper ends 311 of the shrouds 109 extend beyond the upper ends 312 of the tubes 304 to render the test sockets finger safe (IP2X-rated). The screw-less terminal bodies and their respective metal strips 302 are mounted within the shell halves 102 and the folded ends are separated by an insulating wall 307 projecting from the bottom of each shell half 102 to prevent inadvertent contact between the folded contacts 303. Therefore, each of the terminals 106 is connected to one folded contact 303 and one 4 mm test socket 304 via the metal strip 302 as well as to the 2 mm test socket incorporated into the terminal block 301. Connection between the two terminals 106 is made when the link 111 is inserted into the opening 203 and the blades of the staple 202 engage the two folded contacts 303 as seen in FIG. 8. The metal strip 302 (and the folded contacts 303) and the metal staple 202 of the link 111 are all manufactured from 25 μm silver-plated copper strip. The sub-assembly of the terminal blocks 301, metal strips 302, folded contacts 303 and the metal tube 304 of the 4 mm test sockets 304 and the safety shroud 109 are illustrated in FIG. 4 together with the staple 202 of the link 111.

The shell halves 102 are held joined together by co-operating pairs of tongues 313 and receptacles 314 which inter-engage to securely hold the shell halves 102 together.

The removable link 111 may be removed and reinserted in a reversed orientation, as illustrated in FIG. 6, such that there is no connection between the two folded contacts 303. This arrangement enables the link to be "parked" when the circuit connected through the terminal unit 101 is disconnected. The link 111 comprises a pair of shroud parts 201 which partially shroud the conductive staple, and a pair of parts forming the handle 112 that facilitates gripping of the link for easy insertion and removal (in the normal conducting orientation). The shroud parts 201 and handle 112 will generally be moulded in different colours, e.g. the handle may be black and the shroud parts may be red. This difference in colour makes the link 111 more visible when it is inserted in the reversed orientation such that the shroud projects from the opening 203. In the normal (conduction) orientation, the shroud parts will be located entirely within the opening 203 such that only the handle 112 is visible. Resilient projections 114 engage notches 204 in the walls of the opening 203 when the link 111 is inserted in the reverse orientation to retain the link and provide a slight resistance against removal. The shroud parts are also provided with projections 205 that engage the notches 204 when the link is inserted in the normal (conducting) orientation, providing a tactile feedback that the link is fully inserted in either orientation. The insulating wall 307 also acts as a stop to limit the insertion of the link in either orientation and will also limit the insertion of a finger into the opening 302 to prevent it touching the folded contacts 303 when the link is not in place. In the event that the link is not fully inserted in the normal (conduction) orientation, an upper edge of the shroud part will be visible around the edge of the opening 203 indicating the possibility of a high resistance (hot) connection.

As a further safety feature, to prevent touching of the folded contacts 303, the walls of the opening 203 curve inwardly at the lower end and form an aperture 601 (see FIG. 6) through which the blades of the staple 202 must pass to contact the folded contacts 303. The aperture 601 can be limited to a width of around 1-2 mm making it difficult to insert anything into the contacts when they are live. In particular a 4 mm test plug will not pass through the aperture.

The blades of the staple 202 are provided with holes 203 that permit the attachment of a danger label when the link is inserted in the reversed orientation.

When the terminal unit 101 is used in situations where safety procedures dictate that the removable link 111 be removed from the location of the terminal unit (such as by being carried in the pocket of the technician working on the disconnected equipment) dummy links are provided (not illustrated) which can be inserted in place of the link 111 to indicate that the circuit is deliberately disconnected. The dummy links might be manufactured using the same moulded parts 202 & 112 as the link III but with the staple 202 omitted. These dummy links will typically be moulded in a different colour to that of the handle 112 of the link 111, such as red, orange and/or blue.

Electrical Specification (for the Embodiment Described Above)

| | |
|---|---|
| UTILIZATION CATEGORY | AC-20B, DC-20B, suitable for isolation, uninterrupted duty, dependent manual operation. |
| RATED OPERATIONAL VOLTAGE, $U_e$ | 600 Vac 50/60 Hz, or dc. |
| RATED IMPULSE WITHSTAND VOLTAGE, $U_{imp}$ | 6 kV (1.2/50 μs) |
| RATED OPERATIONAL CURRENT, $I_e$ | 32 A in a 70° C. maximum ambient, 40 A in a 60° C. maximum ambient. (see temperature de-rating curve). |
| RATED SHORT-TIME WITHSTAND CURRENT (1s), $I_{cw}$ | 480 A. |
| WIRE CONNECTING CAPACITY | 0.5 to 6 $mm^2$ |

APPLICABLE STANDARDS AS/NZS 3947.3:2001, AS 60947.1-2004

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A terminal unit comprising:

a terminal unit body;

a first terminal connector located adjacent a first opening in the terminal unit body for connection of a first conductor passing through the first opening;

a second terminal connector located adjacent a second opening in the terminal unit body for connection of a second conductor passing through the second opening, the first terminal connector and the second terminal connector being axially aligned along a longitudinal axis of the terminal unit body;

a link opening arranged intermediate the first terminal connector and the second terminal connector;

a first terminal connector conductive element extending internally of the terminal unit body from the first terminal connector to a first link connection point at the link opening;

a second terminal connector conductive element extending internally of the terminal unit body from the second terminal connector to a second link connection point at the link opening, the first and second link connection points being accessible via the link opening; and a removable link comprising a link conductor and a link handle, the removable link being removably insertable into the link opening in a normal orientation, in which the link conductor electrically connects the first link connection point and the second link connection point to electrically connect the first terminal connector to the second terminal connector, wherein the link handle comprises an insulator which projects from the link opening when the link conductor is inserted to electrically connect the first link connection point and the second link connection point, such that the link handle enables gripping of the link for removal without touching the link conductor, wherein the removable link includes an insulating sheath surrounding part of the link conductor, and wherein the link handle and the insulating sheath are of different colours such that the sheath colour is visible when the removable link is inserted into the link opening in a reverse orientation with the link handle inserted in the link opening or when the removable link is not fully inserted into the link opening in the normal orientation.

2. The terminal unit of claim 1 wherein the removable link is shaped to co-operate with the terminal unit body to engage the terminal unit body for storage of the removable link, when the link conductor is not electrically connecting the first link connection point and the second link connection point.

3. The terminal unit of claim 2 wherein the link handle is shaped to fit into the link opening in the terminal unit body, and wherein the removable link is insertable in a reverse orientation with the link handle inserted into the link opening and without connecting the first link connection point to the second link connection point.

4. The terminal unit of claim 3 wherein the link handle includes a resilient projection that engages a wall of the link opening to retain the handle within the link opening.

5. The terminal unit of claim 3 wherein the link handle includes a resilient projection that engages a notch in a wall of the link opening when the link handle is inserted into the link opening.

6. The terminal unit of claim 1 wherein the insulating sheath includes a resilient projection that engages a wall of the link opening to retain the removable link within the link opening.

7. The terminal unit of claim 6 wherein the resilient projection of the sheath engages a notch in a wall of the link opening when the removable link is inserted into the link opening.

8. The terminal unit as claimed in claim 1 wherein the first link connection point and the second link connection point are positioned side by side within the link opening separated by an insulating wall such that they cannot be connected by a straight conductor.

9. The terminal unit of claim 8 wherein the link conductor comprises a flat "U" shaped conductor which, when inserted into the link opening, spans the wall and contacts each of the first link connection point and the second link connection point.

10. The terminal unit as claimed in claim 1 wherein a test socket is connected to one of the first link connection point and the second link connection point.

11. The terminal unit as claimed in claim 1 wherein a test socket is connected to each of the first link connection point and the second link connection point.

12. The terminal unit of claim 10 wherein the socket is a standard 4 mm test sockets and is located to one side of the link opening.

13. The terminal unit as claimed in claim 1 wherein the first terminal connector and the second terminal connector are screw-less type connectors.

14. The terminal unit as claimed in claim 1 wherein the first terminal connector and the second terminal connector are tool-less screw-less type connectors.

15. The terminal unit as claimed in claim 1 wherein the terminal unit is arranged to mount on several different mounting systems.

16. The terminal unit of claim 15 wherein the terminal unit is arranged to mount on either of a DIN-rail or a G-rail.

17. The terminal unit as claimed in claim 1 wherein the terminal unit is adaptable to mount on different mounting systems by replacing a part of the terminal unit.

* * * * *